US010478716B1

(12) United States Patent
Solowiej

(10) Patent No.: US 10,478,716 B1
(45) Date of Patent: Nov. 19, 2019

(54) BOTTLE PUZZLE

(71) Applicant: Henry E. Solowiej, Costa Mesa, CA (US)

(72) Inventor: Henry E. Solowiej, Costa Mesa, CA (US)

( * ) Notice: Subject to any disclaimer, the term of this patent is extended or adjusted under 35 U.S.C. 154(b) by 0 days.

(21) Appl. No.: 16/287,568

(22) Filed: Feb. 27, 2019

(51) Int. Cl.
*A63F 9/08* (2006.01)
*B65D 3/24* (2006.01)

(52) U.S. Cl.
CPC ..... *A63F 9/0857* (2013.01); *B65D 3/24* (2013.01)

(58) Field of Classification Search
CPC .... A63F 9/0857; A63F 9/1208; A63F 9/1204; A63F 2009/1236; A63F 9/1288; B65D 3/24; B65D 1/02; B65D 1/04; A63H 33/08
USPC ..... D21/479
See application file for complete search history.

(56) References Cited

U.S. PATENT DOCUMENTS 4,838,457 A * 6/1989 Swahl ..... B65D 35/28 222/105
4,958,740 A 9/1990 Wilkerson
5,823,531 A * 10/1998 Huber ..... A63F 9/1208 273/156
7,021,625 B2 4/2006 Simmons
7,252,204 B1 8/2007 Small
7,490,831 B2 2/2009 Simmons
8,746,475 B2 6/2014 Kountotsis
9,833,693 B1 12/2017 Solowiej
2005/0098527 A1* 5/2005 Yates, III ..... B29C 49/0073 215/6
2006/0108363 A1* 5/2006 Yates, III ..... B65D 1/04 220/23.4
2007/0029275 A1* 2/2007 Hantman ..... B29C 49/0078 215/6
2019/0239670 A1* 8/2019 Solowiej ..... A47G 21/183

* cited by examiner

*Primary Examiner* — Steven B Wong
(74) *Attorney, Agent, or Firm* — Vladi Khiterer

(57) ABSTRACT

A bottle puzzle used as a training or learning tool for children and adults with cognitive disabilities has puzzle pieces with uniquely shaped concave and convex walls, with only one wall in one puzzle piece matching another wall in a different puzzle piece. Each puzzle piece is a fully contained compartment capable of holding and dispensing beverages. When puzzles are put together, they form a normal bottle that can be filled with beverages contained in the puzzle pieces. A mixing chamber allows consuming several beverages contained in the puzzle pieces simultaneously.

6 Claims, 6 Drawing Sheets

A - A

B - B

BOTTLE PUZZLE

FIELD OF THE INVENTION

The present invention pertains to the field of puzzles, and more particularly to the field of three dimensional puzzles used as training or learning tools for children and adults with cognitive disabilities.

BACKGROUND OF THE INVENTION

It has been known for quite some time that "brain teaser" and "put together" types puzzles are superb learning tools for children and adults with learning or cognitive disabilities. Not only such puzzles sharpen focus and increase problem solving ability, they also improve fine motor skills, cognitive matching skills and enable simple compliance tasks. Most such puzzles of the prior art do not amount to practical or useful items upon completion of the puzzle. Rather, most puzzles of the prior art are viewed and treated as toys. It is, however, useful to have a puzzle that rewards a child or an adult with cognitive disabilities with a tangible result of their effort of putting the puzzle together. What is needed, therefore, is a puzzle that would encourage participation in the puzzle put together activities and even develop attachment to the puzzle by virtue of being a practical and useful item upon completion of the puzzle. Specifically, if the completed puzzle is a bottle comprising different puzzle pieces, the bottle needs to be capable of containing and dispensing beverages directly from the bottle or by using a straw.

SUMMARY OF THE INVENTION

The present invention satisfies this need. The bottle puzzle according to this invention comprises a plurality of puzzle pieces each comprising uniquely shaped walls with only one wall in one puzzle piece matching another wall in a different puzzle piece. Each puzzle piece comprises a fully contained compartment capable of holding and dispensing beverages. When the puzzle pieces are put together, they form a normal bottle that can be filled with one or more beverages and carried by a child or an adult with a cognitive disability after the completion of the puzzle. Several beverages contained in the puzzle pieces can be consumed simultaneously, by dispensing the beverages from the puzzle pieces to the provided mixing chamber. Alternatively, beverages can be consumed individually through a straw inserted into one of the puzzle pieces.

BRIEF DESCRIPTION OF THE DRAWING FIGURES

DETAILED DESCRIPTION OF THE PREFERRED EMBODIMENT

This invention will be better understood with the reference to FIG. 1 through FIG. 6. The same numerals indicate the same elements in all drawing figures.

Figure 1:
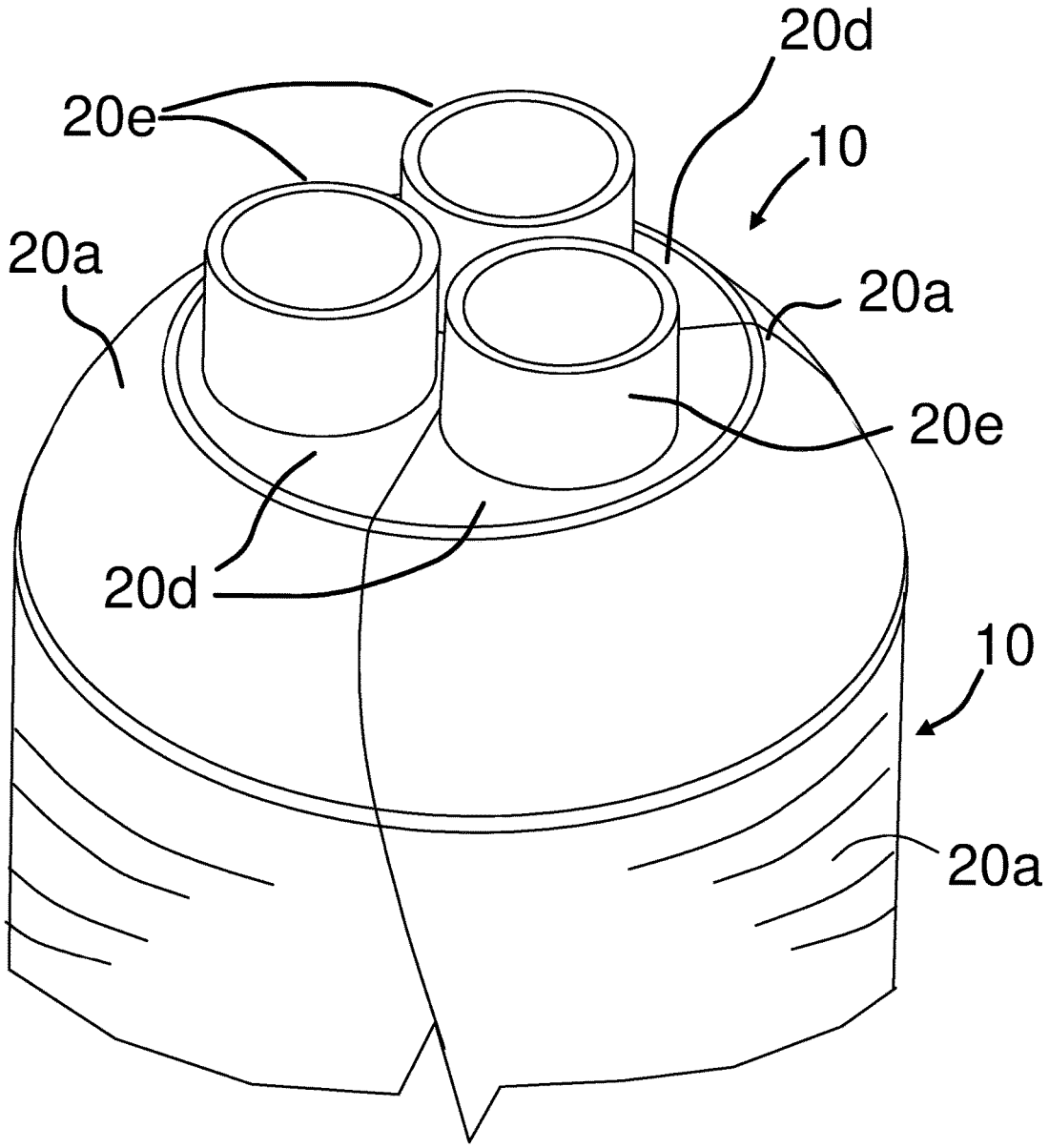
FIG. 1 shows an isometric view of a top portion of a bottle puzzle according is to the preferred embodiment of this invention with the puzzle pieces put together without a crown member.
Figure 2:
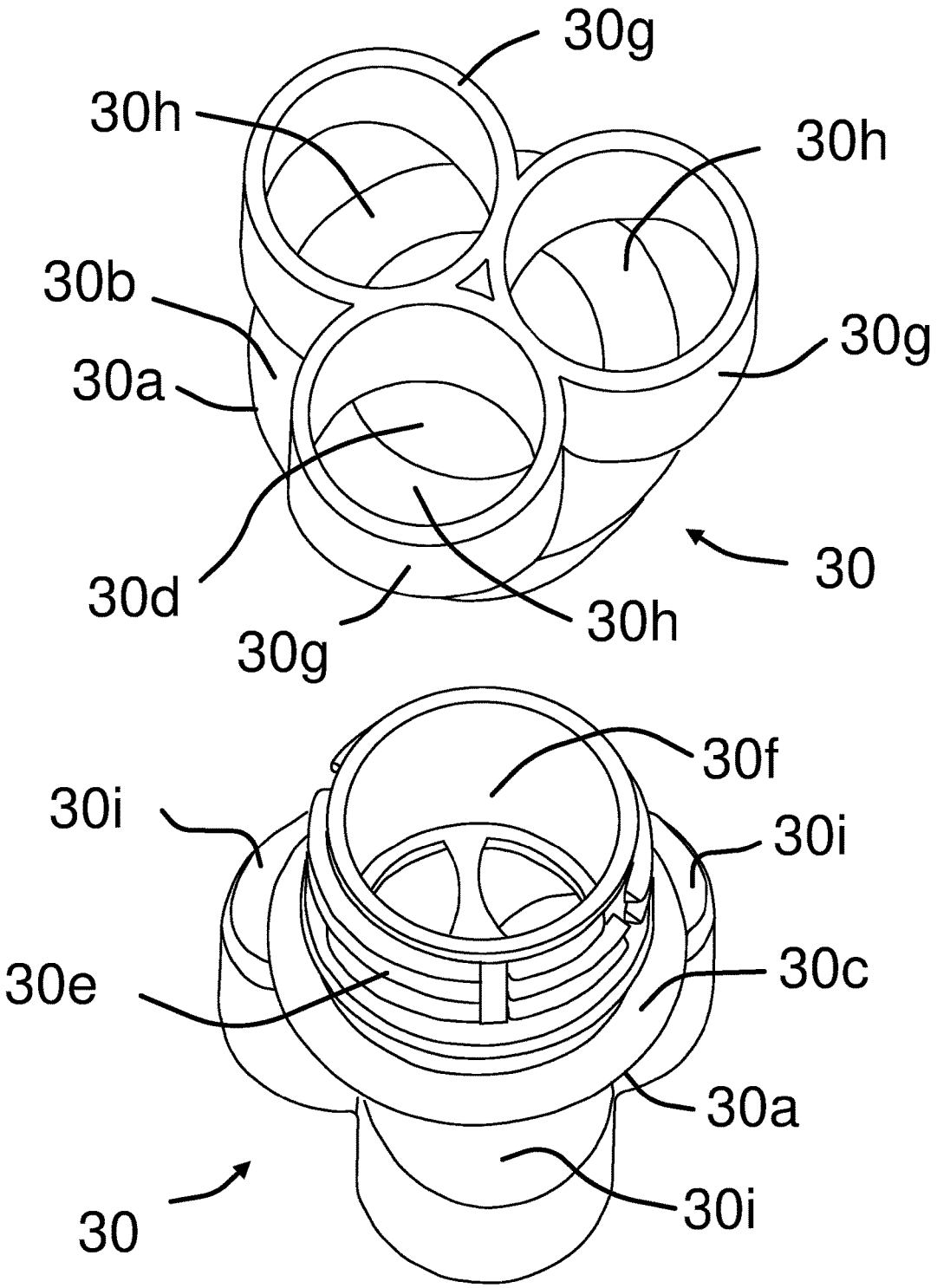
FIG. 2 shows two isometric views of the crown member according to the preferred embodiment of this invention.
Figure 3:
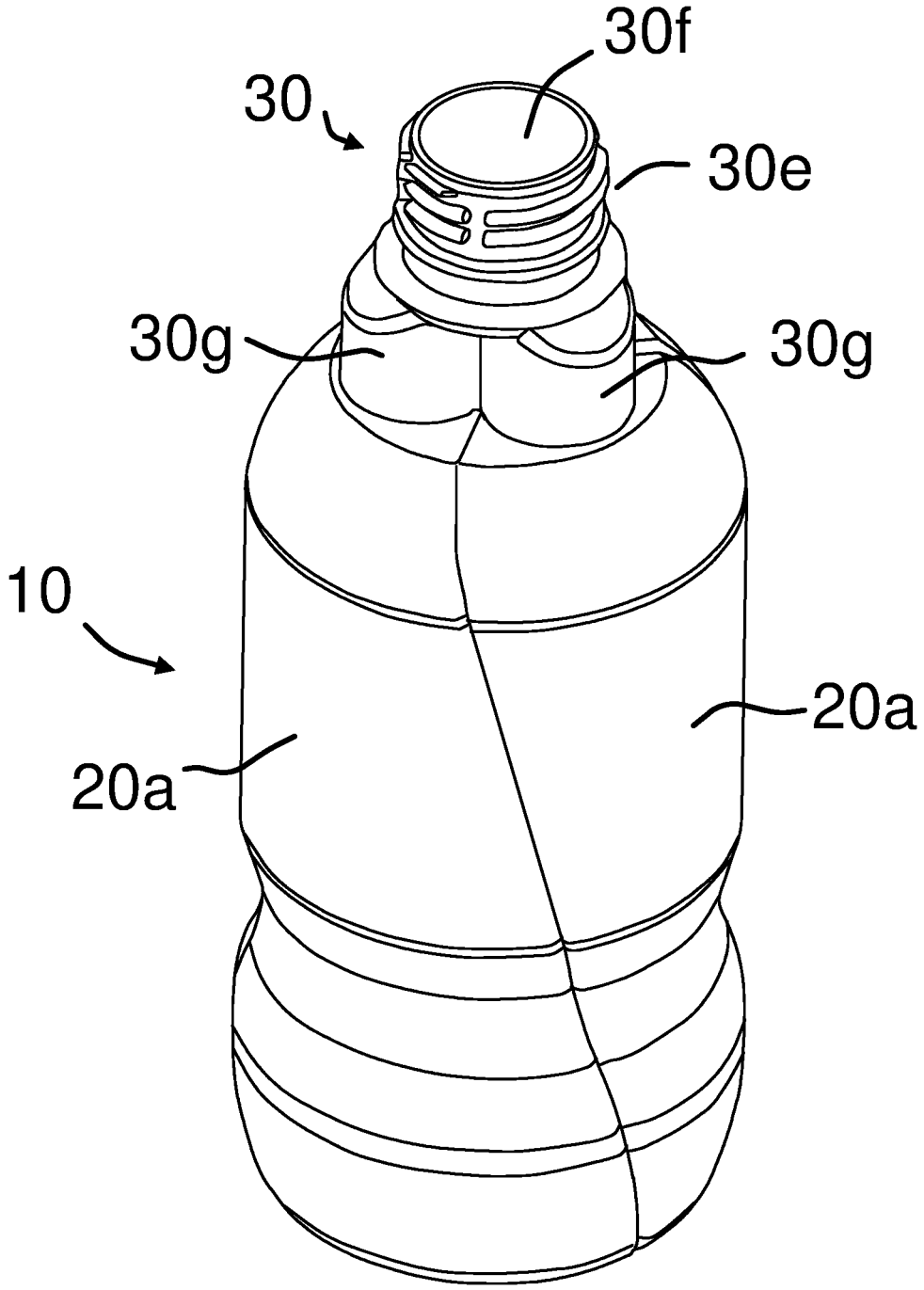
FIG. 3 shows an isometric view of the bottle puzzle according to the preferred embodiment of this invention with the puzzle pieces and the crown member put together.
Figure 4:
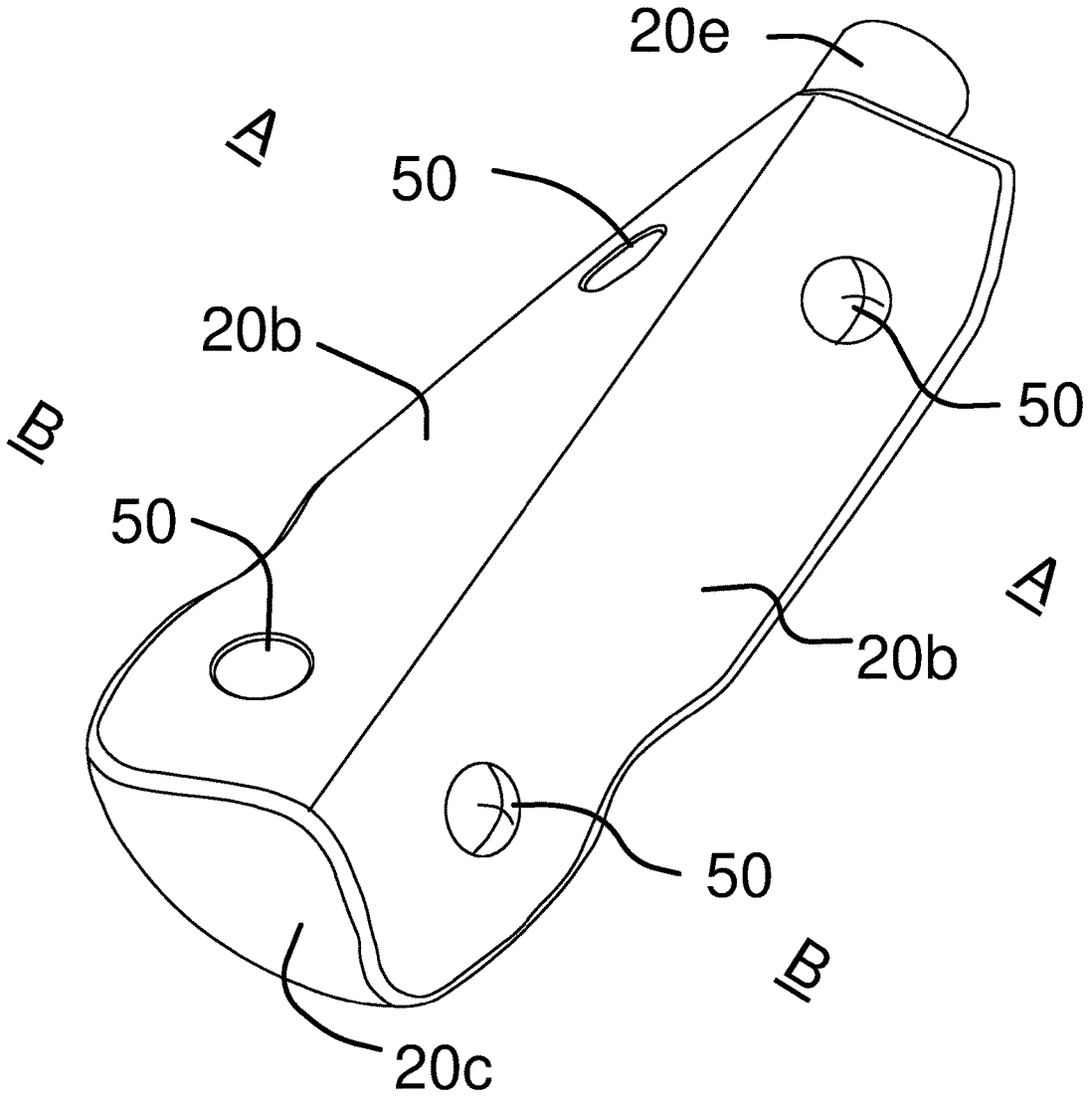
FIG. 4 shows an isometric view of one of the puzzle pieces.

Viewing, simultaneously, FIG. 1, FIG. 3 and FIG. 4, numeral 10 indicates a bottle. Bottle 10 comprises a plurality of puzzle pieces. In the preferred embodiment shown in reference to FIG. 1 through FIG. 6, three puzzle pieces indicated by numeral 20 are shown. However, a smaller or larger number of puzzle pieces can be used.

Puzzle piece 20 comprises an exterior wall indicated by numeral 20*a*, at least one inner wall indicated by numeral 20*b*, a bottom wall indicated by numeral 20*c* and a top wall indicated by numeral 20*d*. Inner wall 20*b* comprises a helical twist.

Numeral 20*e* indicates an outlet. Outlet 20*e* is disposed on top wall 20*d*. Therefore, puzzle piece 20 forms a compartment capable of holding beverages and dispensing them through outlet 20*e*.

Figure 5:
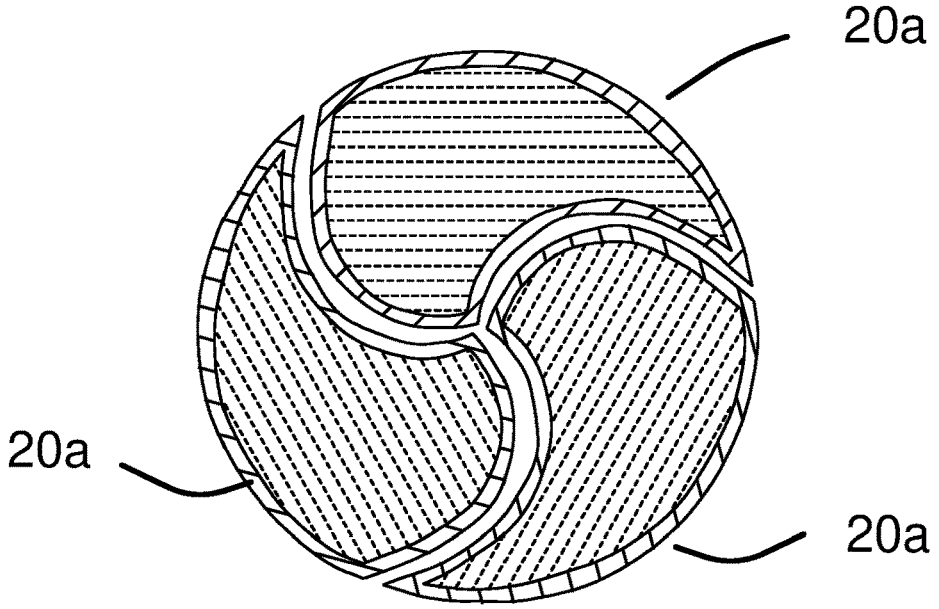
FIG. 5 shows two cross sectional views of the bottle puzzle according to the preferred embodiment of this invention with one cross sectional view having the puzzle pieces put together and one cross sectional view with the puzzle pieces spread apart.
Figure 5:
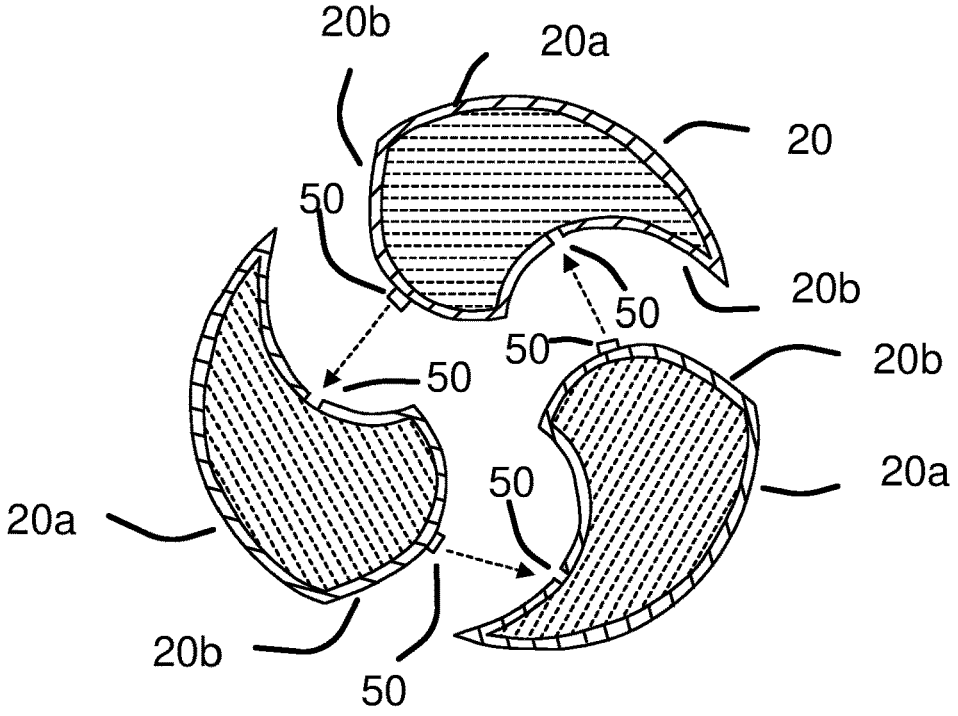

Viewing now FIG. 5, each inner wall 20*b* coincides and engages with only one inner wall 20*b* of another puzzle piece 20. Further, in the preferred embodiment, the coinciding inner walls 20*b* comprise, respectively, convex and concave surfaces.

Viewing, simultaneously, FIG. 2 and FIG. 3, numeral 30 indicates a crown member. Crown member 30 comprises a flat circular flange indicated by numeral 30*a*. Flange 30*a* comprises a top surface indicated by numeral 30*b*, a bottom surface indicated by numeral 30*c* and a circular opening indicated by numeral 30*d*. Numeral 30*e* indicates a threaded neck. Threaded neck 30*e* is disposed on top surface 30*b* over circular opening 30*d*, defining a mixing chamber indicated by numeral 30*f*.

Numeral 30*g* indicates an inlet. A plurality of inlets 30*g* are disposed on bottom surface 30*c*. In the preferred embodiment shown in FIG. 1 through FIG. 6, a total of three inlets 30*g* are shown. Each inlet 30*g* comprises an open bottom end indicated by numeral 30*h* and a partially open top end indicated by numeral 30*i*. Top end 30*i* is open where it coincides with circular opening 30*d* and closed where it does not coincide with circular opening 30*d*.

Each bottom end 30*h* slidably engages, in a fluid sealing manner, with one outlet 20*e*. In the preferred embodiment shown in reference to FIG. 1 through FIG. 6, outlet 20*e* and inlet 30*g* have a cylindrical shape, with the diameter of inlet 30*g* being slightly larger than the diameter of outlet 20*e*, such that inlet 30*g* fits snugly over outlet 20*e*, providing fluid sealing engagement. However, outlet 20*e* and inlet 30*g* do not have to be cylindrical, as long as they slidably engage in a fluid sealing manner.

Top end 30*i* provides fluid communication between inlet 30*g* and circular opening 30*d* and prevents fluid communication with the outside of inlet 30*g*. This allows beverages from different puzzle pieces 20 to mix inside the mixing chamber 30*f*, such that a user can consume mixed beverages. Alternatively, a straw may be inserted through top end 30*i* into puzzle piece 20, such that the user can consume an individual, unmixed, beverage.

Viewing now FIG. 4, numeral 50 indicates an attachment means. Attachment means 50 is disposed on the coinciding inner walls 20*b*. Attachment means 50 attach puzzle pieces 20 to one another. In the preferred embodiment shown in FIG. 4, attachment means 50 comprises at least one raised male interlock portion (shown on the right inner wall 20*b*) and at least one recessed mating female interlock portion (shown on the left inner wall 20*b*). Female interlock portion engages and latches with the male interlock portion.

Nevertheless, a variety of attachment means can be used to attach puzzle pieces 20 to one another, including Velcro, double sided sticky tape, rubber bands, magnets, glue.

Figure 6:
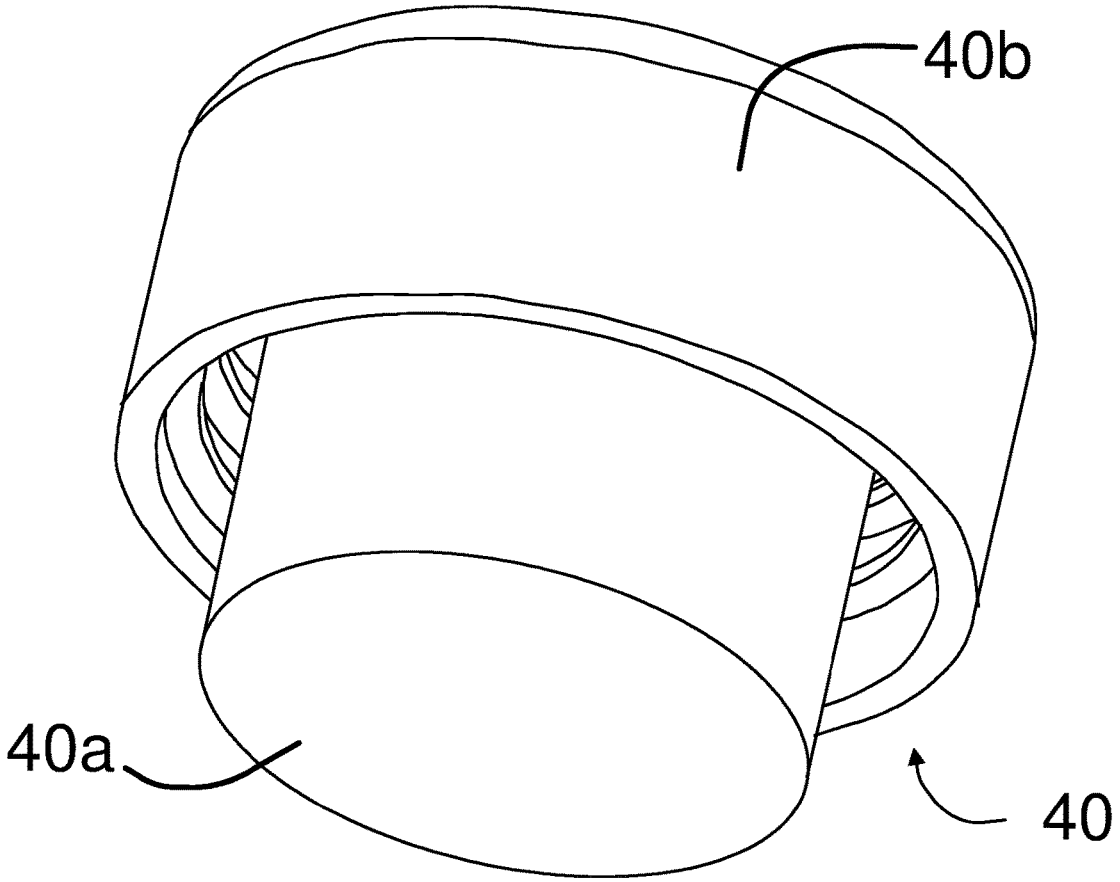
FIG. 6 shows an isometric views of a cap.

Viewing now FIG. 6, numeral 40 indicates a cap. Cap 40 comprises a cork indicated by numeral 40*a* and a threaded flange indicated by numeral 40*b*.

Cork 40*a* is adapted for insertion into mixing chamber 30*f*, such that it abuts against top end 30*i* and provides fluid sealing of circular opening 30*d*. Threaded flange 40*b* is disposed over cork 40*a* and is configured for engaging with and attaching to threaded neck 30*e*.

Therefore, when cap 40 is on, cork 40*a* prevents beverages from different puzzle pieces 20 from mixing.

Puzzle pieces 20 in the preferred embodiment shown in reference to FIG. 1 through FIG. 6 are made from a material selected from the group consisting of plastic and aluminum. Puzzle pieces 20 made from plastic, such as polyethylene terephthalate (PET) can be made by way of injection molding or 3-D printing. Puzzle pieces 20 made from aluminum can be made by way of the blow-molded aluminum bottle technology.

While the present invention has been described and defined by reference to the preferred embodiment of the invention, such reference does not imply a limitation on the invention, and no such limitation is to be inferred. The invention is capable of considerable modification, alteration, and equivalents in form and function, as will occur to those ordinarily skilled and knowledgeable in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

I claim:

1. A bottle puzzle comprising a plurality of puzzle pieces and a crown member for detachably assembling the puzzle pieces to one another and to the crown member to form a bottle comprising a substantially cylindrical body with a threaded neck receiving a cap;

whereas, each puzzle piece comprising an exterior wall, at least one inner wall, the inner wall comprising a helical twist, a bottom wall, a top wall, an outlet disposed on the top wall, thereby forming a compartment capable of holding beverages and dispensing them through the outlet, such that each inner wall coinciding and engaging with only one inner wall of another puzzle piece;

whereas, the crown member comprising a flat circular flange having a top surface, a bottom surface and a circular opening, the threaded neck disposed on the top surface over the circular opening and defining a mixing chamber, a plurality of inlets disposed on the bottom surface, each inlet comprising an open bottom end and a partially open top end, whereas, each bottom end slidably engaging in a fluid sealing manner with one outlet, the top end providing fluid communication between the inlet and the circular opening and preventing fluid communication with the outside of the inlet.

2. A bottle puzzle as in claim 1 further comprising attachment means disposed on the coinciding inner walls, attaching the puzzle pieces to one another.

3. A bottle puzzle as in claim 2, wherein the coinciding inner walls comprise, respectively, convex and concave surfaces.

4. A bottle puzzle as in claim 3, wherein the attachment means comprises at least one raised male interlock portion and at least one recessed mating female interlock portion engaging and latching with the male interlock portion.

5. A bottle puzzle as in claim 4, wherein the cap comprising a cork adapted for insertion into the mixing chamber, the cork configured for fluid sealing of the circular opening by way of abutting against the partially open top end, a threaded flange disposed over the cork configured for engaging with and attaching to the threaded neck.

6. A bottle puzzle as in claim 5, wherein the puzzle pieces are made from a material selected from the group consisting of plastic and aluminum.

* * * * *